US007666014B2

(12) United States Patent
Yi et al.

(10) Patent No.: US 7,666,014 B2
(45) Date of Patent: Feb. 23, 2010

(54) HIGH DENSITY CONNECTOR ASSEMBLY HAVING TWO-LEVELED CONTACT INTERFACE

(75) Inventors: Chong Yi, Mechanicsburg, PA (US); Kuan-Yu Chen, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,112

(22) Filed: Jun. 6, 2008

(65) Prior Publication Data

US 2009/0264001 A1 Oct. 22, 2009

Related U.S. Application Data

(63) Continuation-in-part of application No. 12/148,757, filed on Apr. 22, 2008.

(51) Int. Cl.
*H01R 13/64* (2006.01)

(52) U.S. Cl. ..... 439/248

(58) Field of Classification Search ..... 439/248, 439/660, 701
See application file for complete search history.

(56) References Cited

U.S. PATENT DOCUMENTS 3,673,545 A * 6/1972 Rundle ..... 439/248
4,944,568 A * 7/1990 Danbach et al. ..... 385/88
5,052,936 A 10/1991 Biechler et al.
5,137,462 A * 8/1992 Casey et al. ..... 439/74
5,330,359 A * 7/1994 Walker ..... 439/69
5,904,581 A 5/1999 Pope et al.
5,961,355 A * 10/1999 Morlion et al. ..... 439/686
6,068,518 A 5/2000 McEuen
6,155,858 A * 12/2000 Ozawa et al. ..... 439/248
6,319,075 B1 * 11/2001 Clark et al. ..... 439/825
6,409,543 B1 * 6/2002 Astbury et al. ..... 439/608
6,453,550 B1 * 9/2002 Farnworth et al. ..... 29/842
6,475,019 B1 * 11/2002 Zielke et al. ..... 439/404
6,981,883 B2 * 1/2006 Raistrick et al. ..... 439/74
7,104,848 B1 9/2006 Chou et al.
7,137,832 B2 * 11/2006 Mongold et al. ..... 439/108
7,431,616 B2 * 10/2008 Minich ..... 439/608
2003/0220021 A1 * 11/2003 Whiteman et al. ..... 439/608
2004/0259419 A1 * 12/2004 Payne et al. ..... 439/608
2006/0063404 A1 * 3/2006 Minich et al. ..... 439/79
2007/0287336 A1 * 12/2007 Buck et al. ..... 439/680

* cited by examiner

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

A connector assembly (100) includes a first connector (10) and a mating second connector (30). Each connector includes a number of leadframes (21, 41) stacked one by one. Each leadframe has a first leadframe housing (211, 411) and a second leadframe housing (214, 414) attached to the first leadframe housing. Each connector includes an array of first terminals (5) and an array of second terminals (6) respectively mounted along the second and the first leadframe housings, and a pair of latching members (25, 45) mounted at opposite sides of the leadframes together with the first and second terminals to tie the plurality of stacked leadframes as a whole.

19 Claims, 14 Drawing Sheets

HIGH DENSITY CONNECTOR ASSEMBLY HAVING TWO-LEVELED CONTACT INTERFACE

This patent application is a continuation-in-part of a pending U.S. patent application Ser. No. 12/148,757 filed Apr. 22, 2008, entitled "HIGH DENSITY CONNECTOR HAVING TWO-LEVELED CONTACT INTERFACE", which is invented by the same inventor as this patent application and assigned to the same assignee with this application.

BACKGROUND OF THE INVENTION

1. Field of the Invention

The present invention relates to a high density connector and particularly to a connector assembly utilizing such high density connectors to create a unique connection interface.

2. Description of Related Art

In card edge connectors, it is known to arrange contacts in two levels. U.S. Pat. No. 5,052,936 issued on Oct. 1, 1991 to Biechler et al. exemplifies a connector. In this design, two arrays of aligned contact members for interfacing either side of a board or card edge are insert molded to a lower subassembly housing which in turn is assembled to an upper housing. The board or card edge is provided with an upper level of contact pads and a lower level of contact pads. When the board or card edge is inserted into the housing, the lower level of contact pads electrically connect with a first array of contact members of the connector and the upper level of contact pads electrically connect with a second array of contact members.

The contact member is disposed in an unforced status when the card edge is not inserted into the housing. The contact member would tilt to contact with the contact pads of the card edge, when the card edge is inserted into the housing. When the card edge is inserted into or pulled out from the housing for many times, the contact member would become less resilient to thereby have an unreliable engagement between the card edge and the housing.

U.S. Pat. No. 6,371,773 issued on Apr. 16, 2002 to Crofoot et al. discloses a high density interconnect system used in association with printed circuit boards, circuit cards, back panels and other like substrates. The interconnect system comprises electrical connector modules each having a plurality of signal conductors substantially parallel within a first plane and a reference conductor element made of a single piece of sheet metal. The reference conductor element includes a plurality of first reference conductors substantially parallel to one another and interspersed between the signal conductors and at least part of which are in the first plane and a plurality of second reference conductors within a second plane which is offset from and substantially parallel to the first plane. The second reference conductor is aligned with the signal conductor in a direction perpendicular to the plane of the connector module. However, when the connector modules of two mating connector portions are mated, curved contact ends of mating signal conductors make a hermaphrodite mating while associated second reference conductors only shield beside the mated signal conductor but not touch each other.

The signal conductors and the reference conductors are respectively inserted on one plane to combine themselves as a whole. When it is needed to choose a certain number of conductors, it is not convenient to insert proper number of conductors into the plane, or remove the redundant conductors one by one.

SUMMARY OF THE INVENTION

An object of the present invention is to provide a connector assembly comprises a first connector and a mating second connector. Each connector includes a number of leadframes stacked one by one. Each leadframe has a first leadframe housing and a second leadframe housing attached to the first leadframe housing. Each connector includes an array of first terminals and an array of second terminals respectively mounted along the second and the first leadframe housings, and a pair of latching members mounted at opposite sides of the leadframes together with the first and second terminals to tie the plurality of stacked leadframes as a whole. The leadframe has a shelf between said two arrays of first and second terminals. The first terminal has a tip end resisting against an inner surface of the shelf. The first terminal and the second terminal of said two connectors come to contact with each other and the tip end of the first terminal leaves away from the shelf, when the first and second connectors are mated with each other.

The plurality of leadframes are stacked one by one to optimize the space usage. The plurality of stacked leadframes are tied as a whole via the latching member. It isn't necessary to fix the leadframes in virtue of a housing and it is easy to assemble proper number of leadframes in accordance with different requires. Additionally, the tip end of the first terminal resists against an inner surface of the shelf and the shelf provides a pre-loaded force to the first terminal when the first terminal is not mating with corresponding second terminal. The first terminal could engage with corresponding second terminal reliably, since it has been pre-loaded.

Other objects, advantages and novel features of the invention will become more apparent from the following detailed description of a preferred embodiment when taken in conjunction with the accompanying drawings.

DETAILED DESCRIPTION OF THE INVENTION

Figure 1:
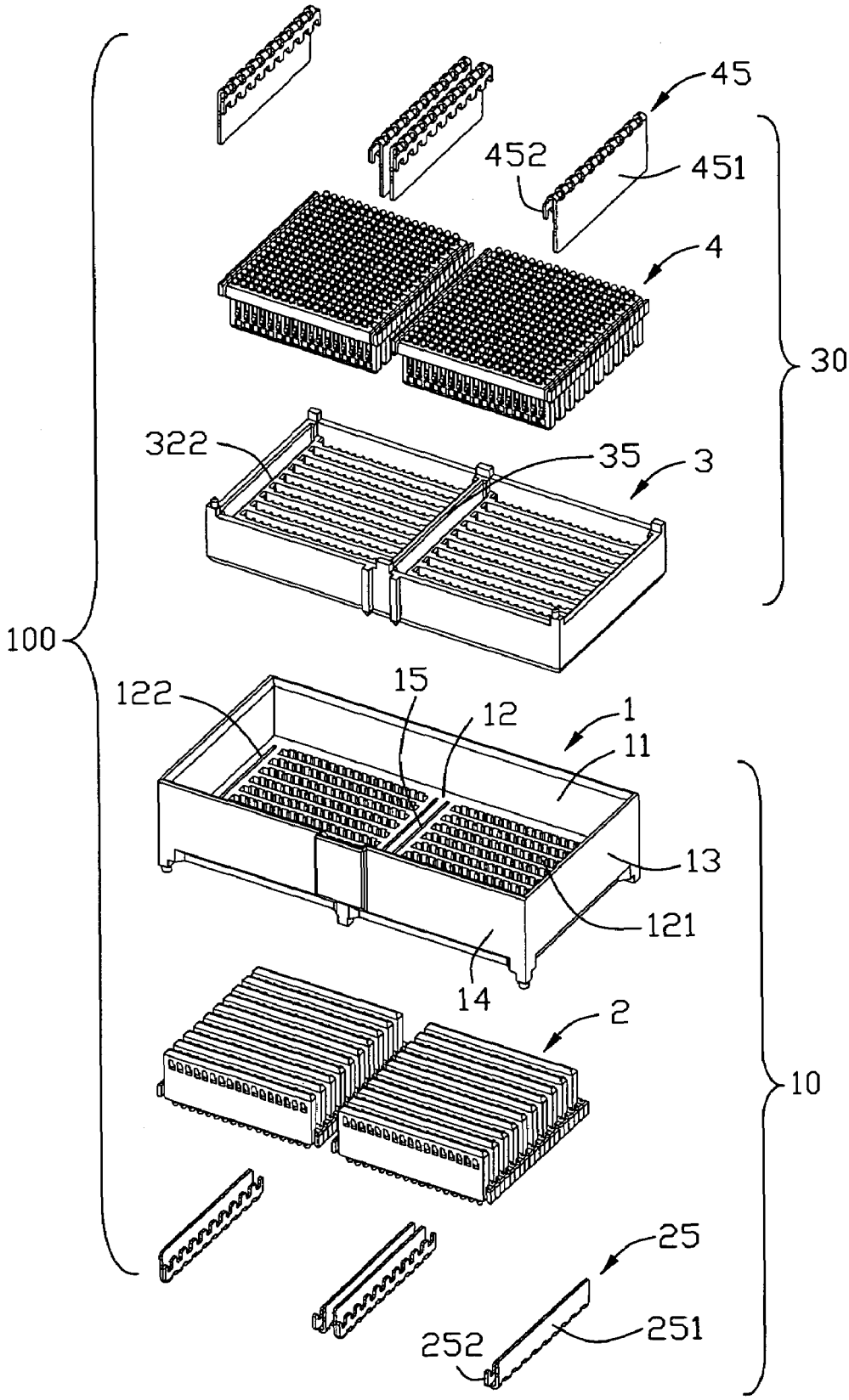
FIG. 1 is an exploded perspective view of a connector assembly in accordance with the present invention.

Reference will now be made to the drawing figures to describe the present invention in detail. Referring to FIGS. 1-6, a high density mezzanine connector assembly 100 in accordance with the preferred embodiment of the present invention comprises a first connector 10 and a second mating connector 30. The first connector 10 is shown as a female connector in view of its housing structure and will be so called in the following description. Similarly, since the second connector 30 is shown as a male connector in view of its interface housing structure, it will be so called in the following description for ease of reference and clarity, but not in the sense of limiting.

Referring to FIGS. 1-4, the female connector 10 comprises a rectangular female insulative housing 1 defining a receiving cavity 11, a plurality of female terminal modules 2 arranged in two groups in the receiving cavity 11 of the female insulative housing 1 and a plurality of first latching members 25. The female insulative housing 1 is formed with a bottom wall 12, a pair of primary walls 14 and a pair of periphery walls 13 extending upwardly from the bottom wall 12 for surrounding the receiving cavity 11. The bottom wall 12 defines thereon two groups of channels 121, and a middle wall 15 between the two groups of channels 121. The bottom wall 12 has four second slots 122 each defined alongside the periphery wall 13 or middle wall 15. Optionally, the bottom wall 12 could define only one group of channels 121 and the middle wall 15 would be removed.

Figure 7:
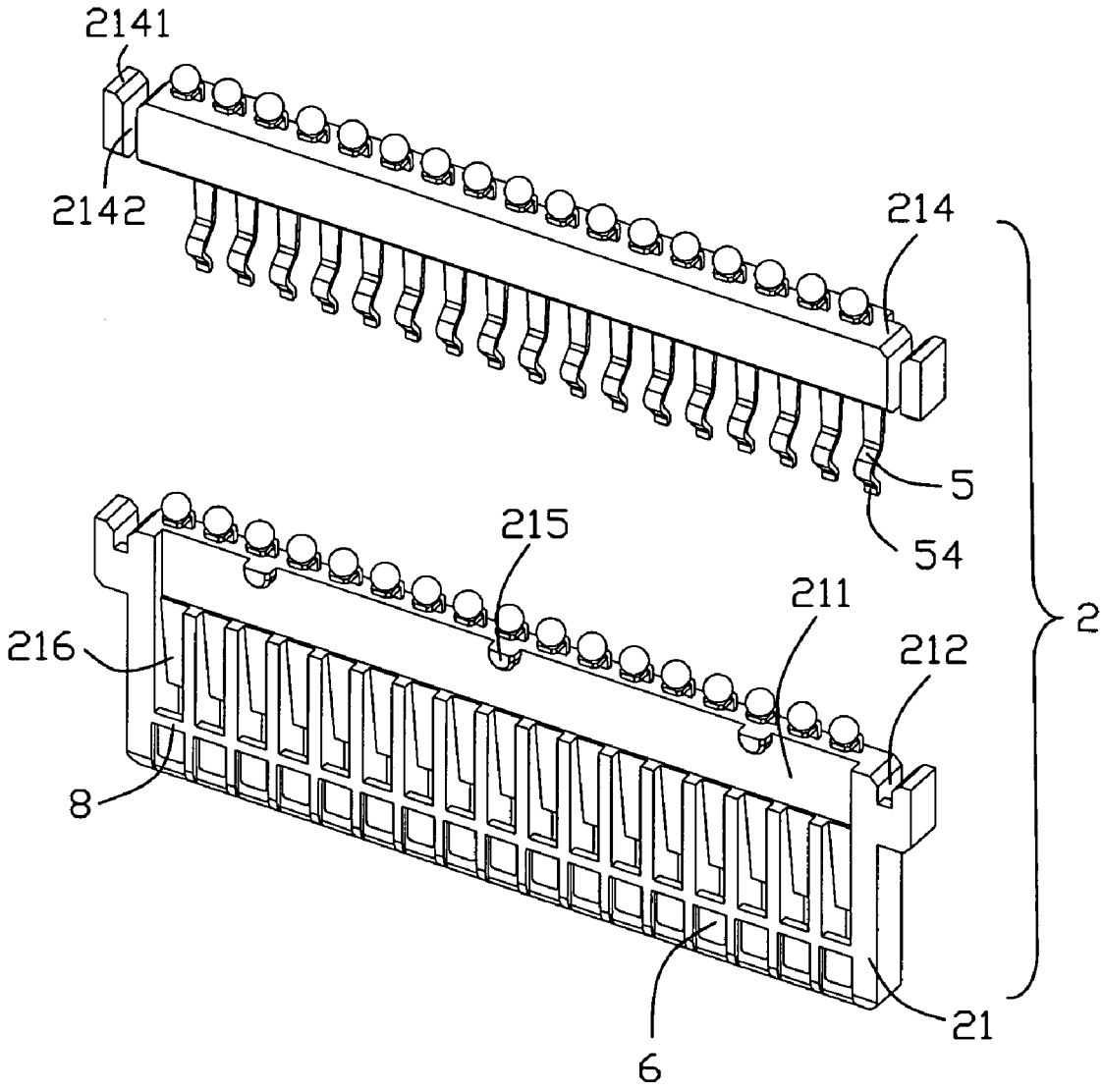
FIG. 7 is a partially exploded view of a female terminal module.
Figure 13:
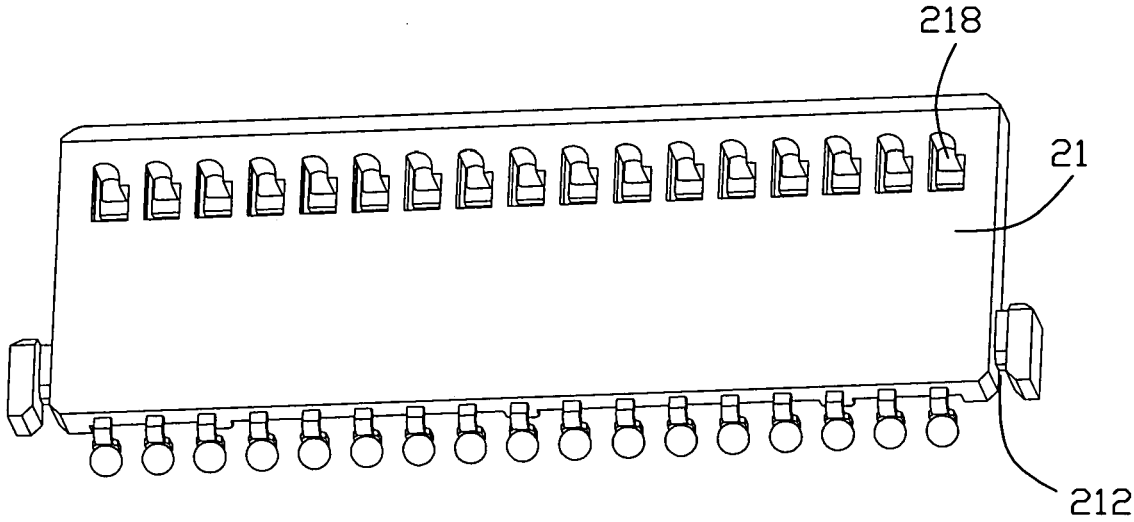
FIG. 13 is another perspective view of the leadframe as shown in FIG. 7.
Figure 14:
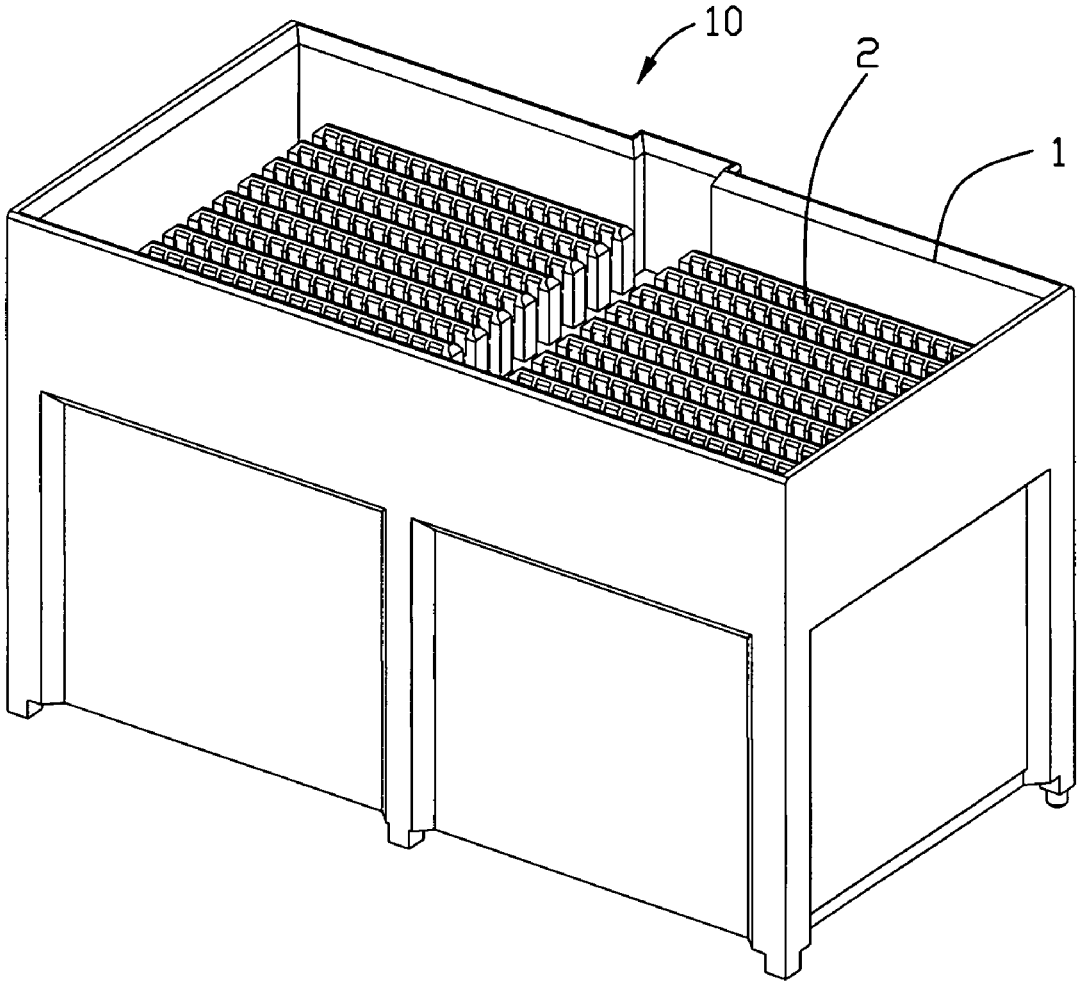
FIG. 14 is a perspective view of the female connector, with the female insulative housing having another height.

In conjunction with FIG. 7, each female terminal module 2 comprises a female plate 21 having two leadframe housings 211, 214 and an array of female terminal pairs 22 mounted along the leadframe housings 211, 214. The leadframe housing 211 has a plurality of terminal recesses 216 for accommodating the first terminals 5. Such leadframe housing 211 has a pair of first slots 212 symmetrically defined at two opposite ends thereof. FIG. 13 shows a rear face of the leadframe housing 211 defining a plurality of pin holes 218. The leadframe housing 214 has a pair of ear portions 2141 formed at opposite ends thereof. Each ear portion 2141 defines a slit 2142 aligned with the first slot 212 of the leadframe housing 211. In conjunction with FIG. 9, each female terminal pair 22 has a first terminal 5 retained to the leadframe housing 214 and a second terminal 6 retained to the leadframe housing 211. The pin holes 218 support the second terminals 6 during insert molding. The leadframe housing 211 is formed with a shelf 8 across the pin holes 218.

Figure 2:
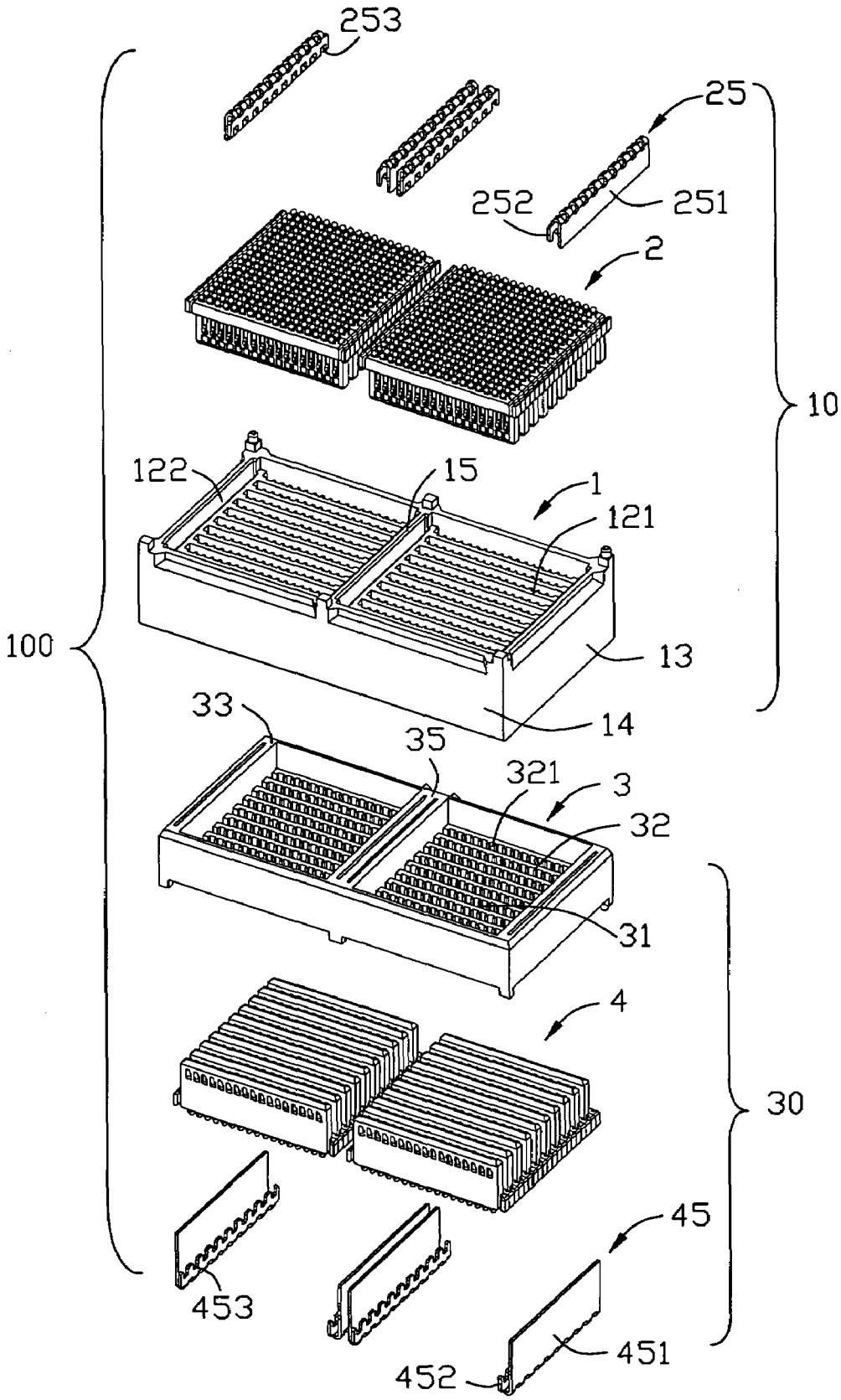
FIG. 2 is another exploded perspective view similar to FIG. 1, taken from another aspect.
Figure 3:
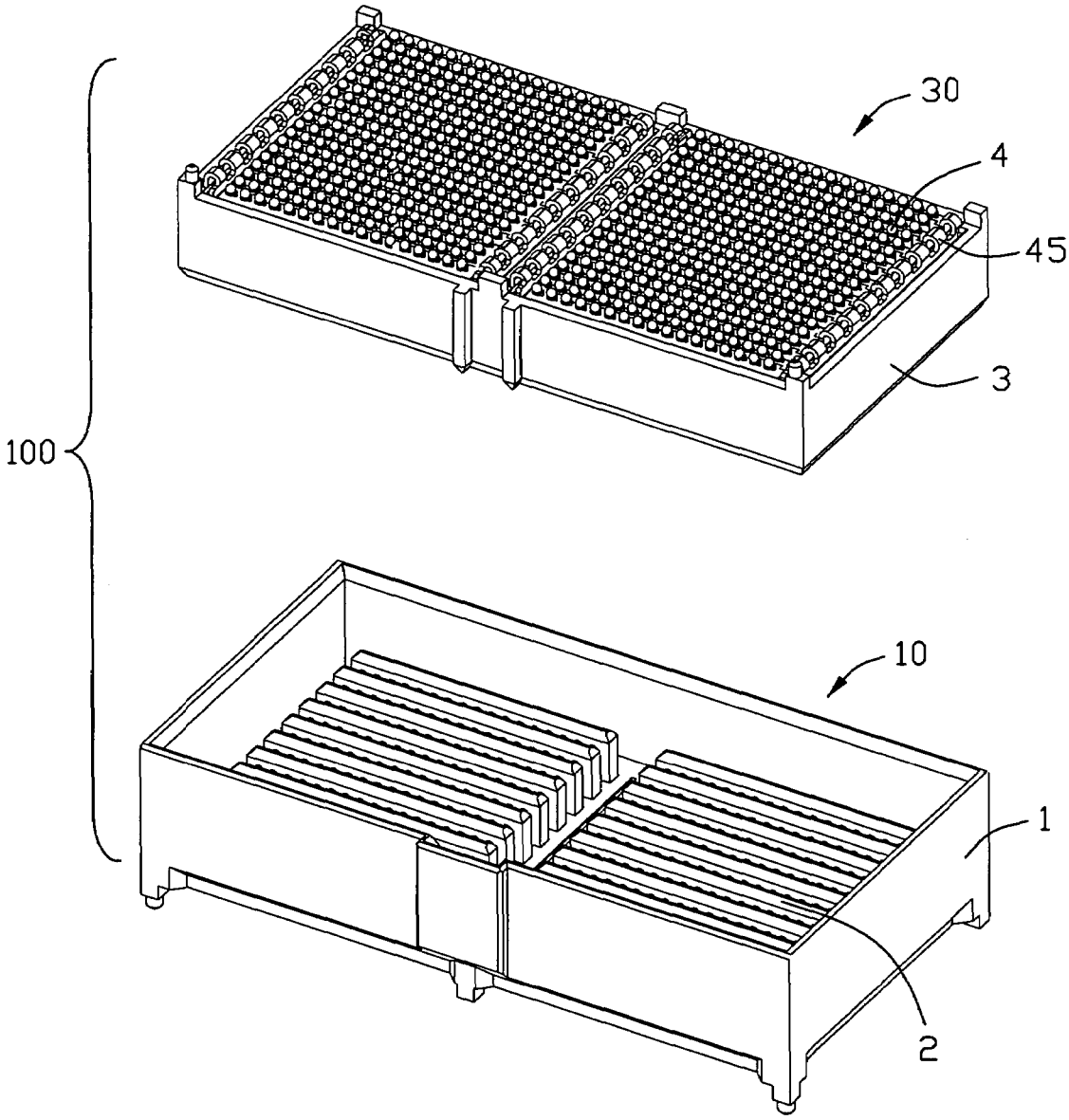
FIG. 3 is a perspective view showing an assembled female connector not mating with an assembled male connector.
Figure 4:
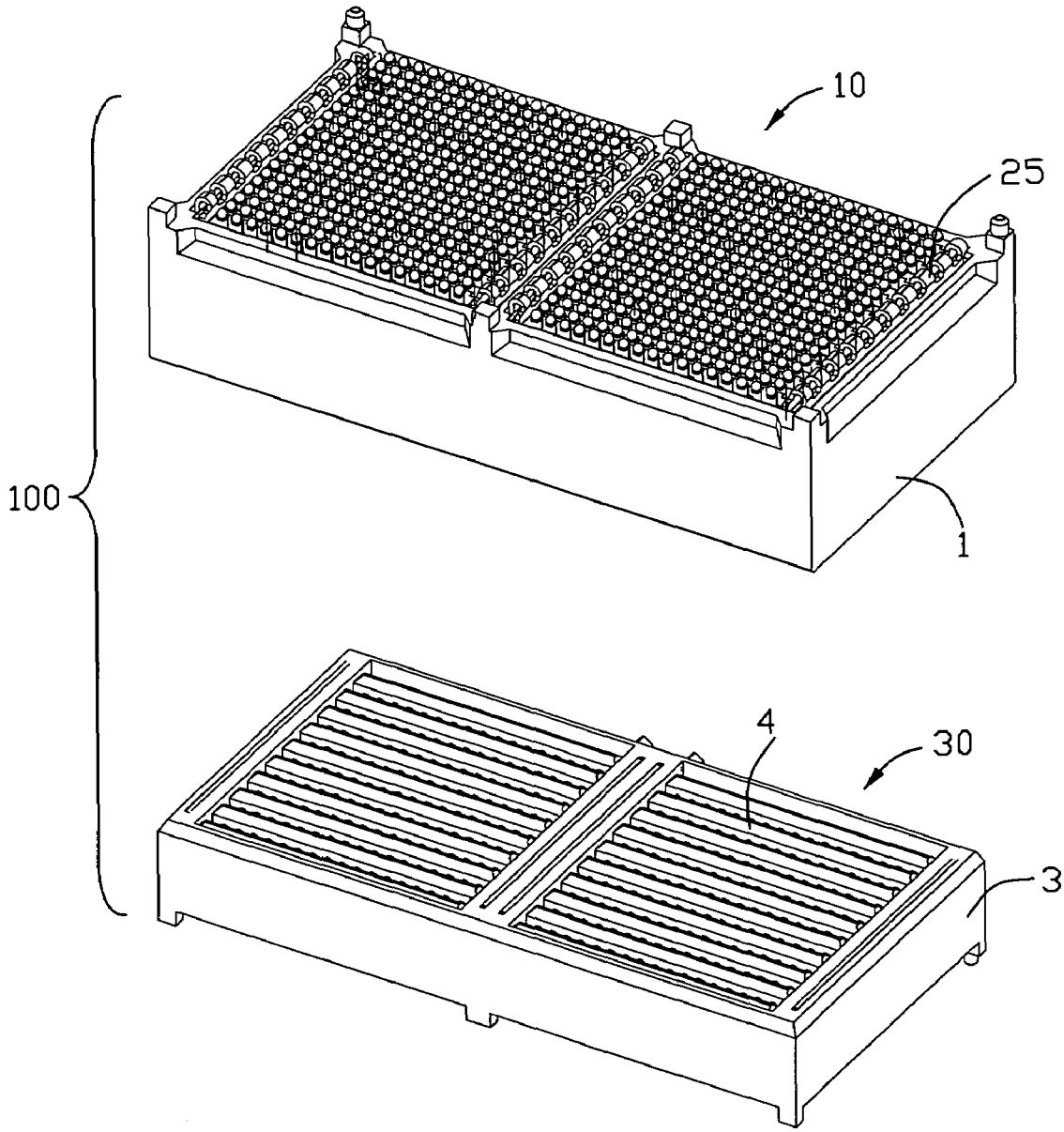
FIG. 4 is another perspective view showing the assembled female connector not mating with the assembled male connector, taken from another aspect.
Figure 5:
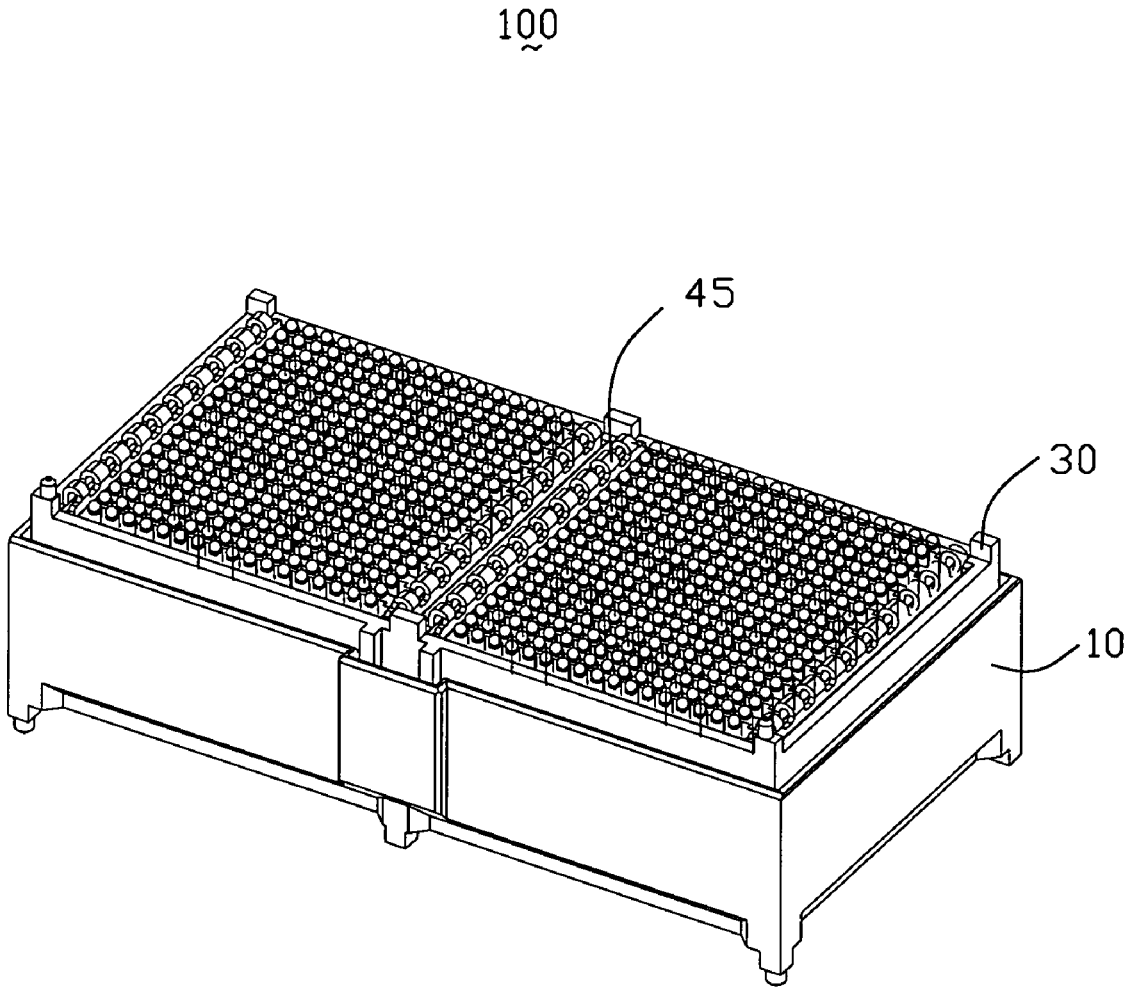
FIG. 5 is an assembled perspective view of the connector assembly as shown in FIG. 1.
Figure 6:
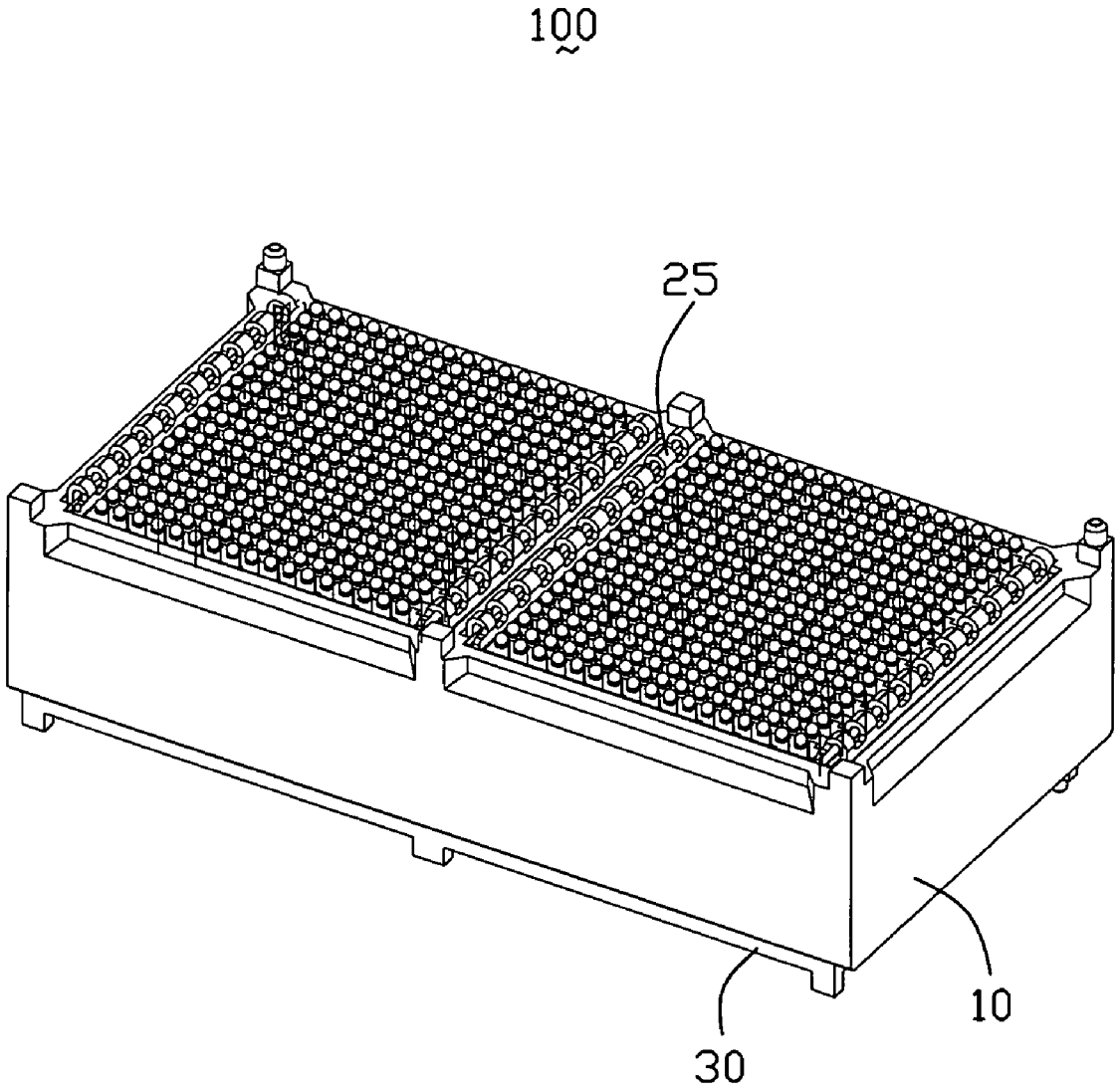
FIG. 6 is another assembled perspective view of the connector assembly as shown in FIG. 5, taken from another aspect.

Referring to FIGS. 1-2, the first latching member 25 comprises a body portion 251 insertable in the second slot 122 of the female insulative housing 1, and a bending portion 252 bending from the body portion 251 and insertable into the first slot 212 of the female plate 21. The bending portion 252 defines a plurality of cutouts 253 engageable with the first slot 212 of the female plate 21.

The male connector 30 comprises a male insulative housing 3 defining a receiving cavity 31 and a plurality of male terminal modules 4 retained to the housing 3 in the retaining cavity 31. The female and male terminal modules 2 and 4 are similarly constructed, at least as to their mating interface, as will be detailed later. The male insulative housing 3 also has a configuration similar to the that of the female insulative housing 1 and comprises a base or bottom wall 32 and a pair of side walls 33. The bottom wall 32 defines two groups of channels 321 and a plurality of second slots 322 along the side walls 33 and middle wall 35.

Figure 8:
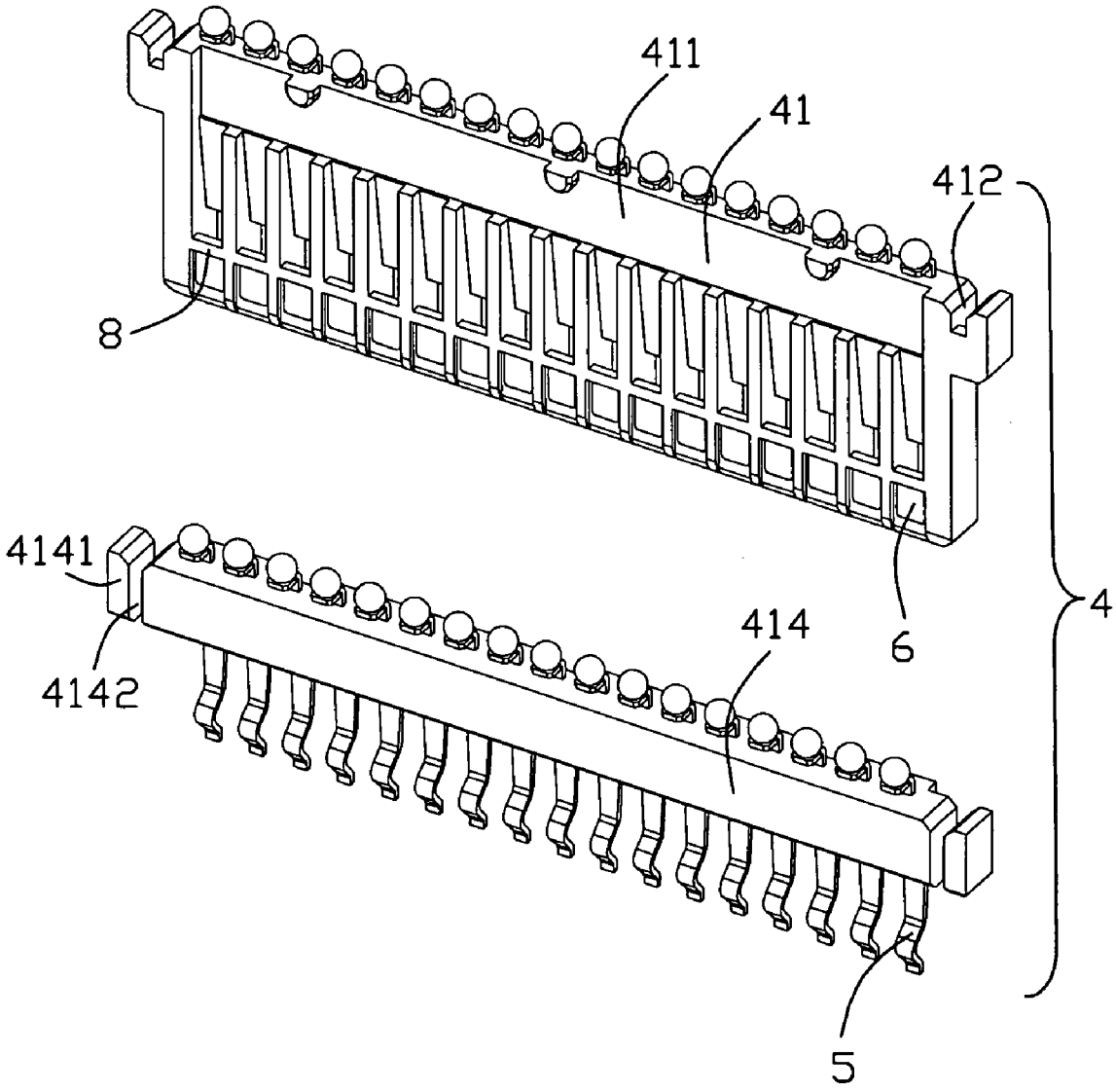
FIG. 8 is a partially exploded view of a male terminal module.

In conjunction with FIG. 8, each male terminal module 4 comprises a male plate 41 having two leadframe housings 411 and 414 and a plurality of male terminal pairs 42 mounted along the leadframe housings 411, 414. The leadframe housing 411 has a configuration similar to that of the leadframe housing 211 and comprises a pair of first slots 412. The leadframe housing 414 has a pair of ear portions 4141 formed at opposite ends thereof. Each ear portion 4141 defines a slit 4142 aligned with the first slot 412 of the leadframe 411. In conjunction with FIG. 9, each male terminal pair 42 has a first terminal 5 retained to the leadframe housing 414 and a second terminal 6 retained to the leadframe housing 411.

Figure 9:
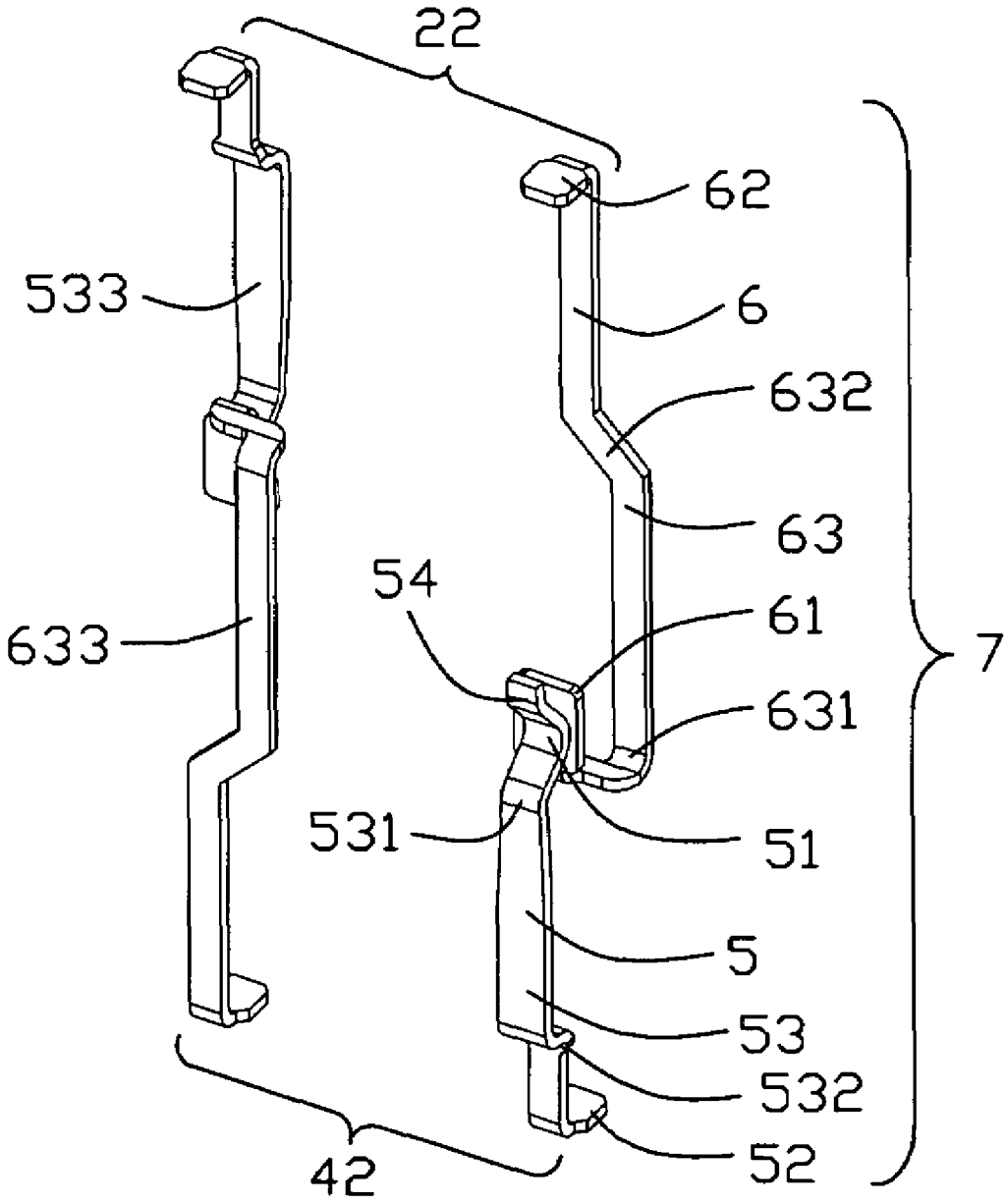
FIG. 9 is an enlarged perspective view showing a female terminal pair mating with a male terminal pair.
Figure 10:
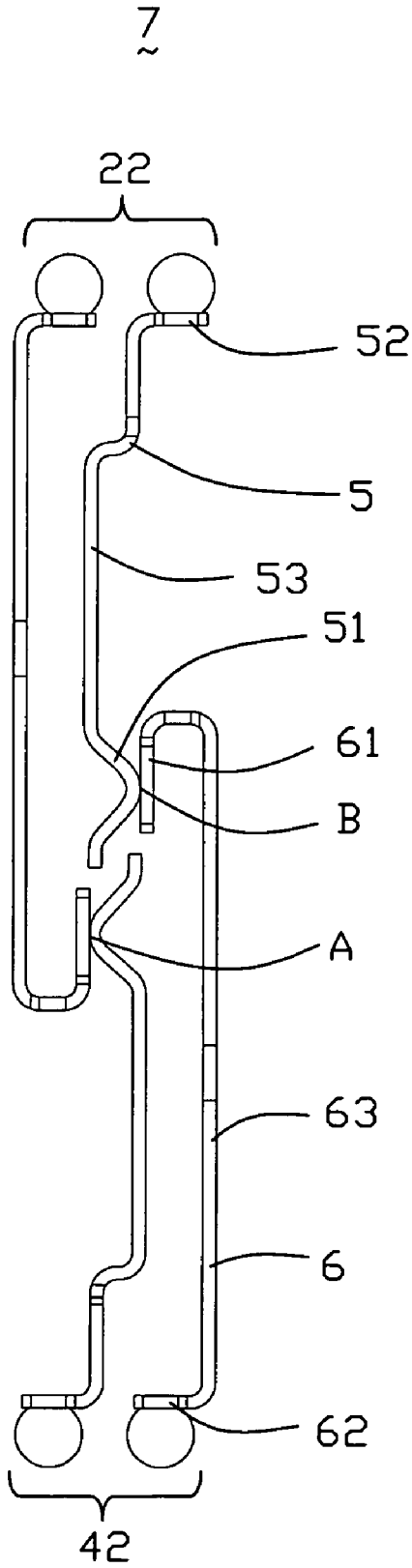
FIG. 10 is a schematic view showing the female terminal pair mating with corresponding male terminal pair.
Figure 11:
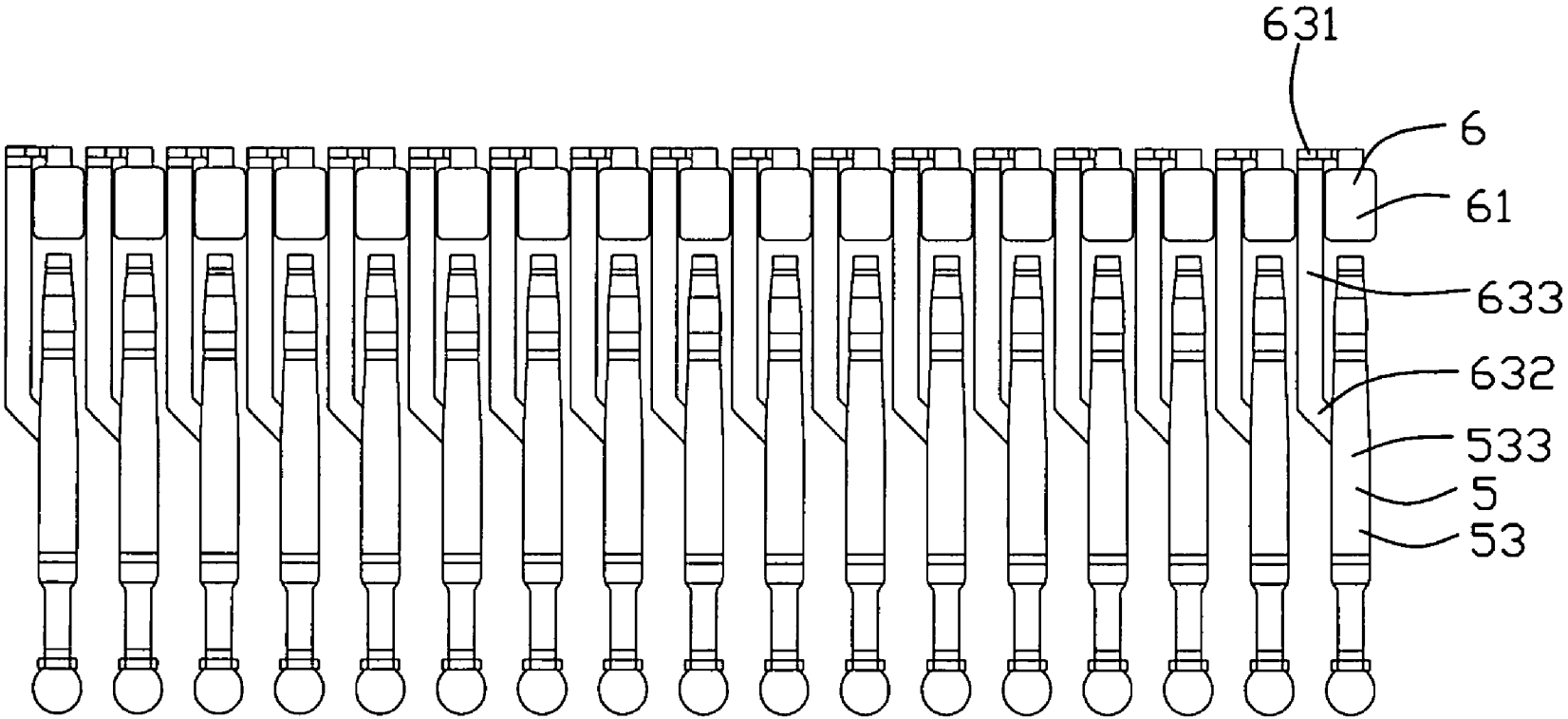
FIG. 11 is a front view showing the first and second terminals arranged along a leadframe, with the leadframe being removed.

In conjunction with FIGS. 9 and 10, the first terminal 5 and the adjacent second terminal 6 in a same connector are formed as a female terminal pair 22 or a male terminal pair 42. Each female terminal pair 22 and each mating male terminal pair 42 are hermaphroditic relative to each other. The first terminal 5 and the mating second terminal 6 is formed as a signal terminal pair 7. The first terminal 5 comprises a contact portion 51 having a curved mating face, a terminating end 52, and a contact beam 53 connecting the contact portion 51 and the terminating end 52. The contact beam 53 comprises a first and a second angled portion 531, 532 angled toward the second terminal 6 in one signal terminal pair 7 and an intermediate portion 533 between the first and second angled portions 531, 532.

The second terminal 6 comprises a connecting portion 61 having a flat mating face, a terminating end 62, and a connecting beam 63 connecting the connecting portion 61 and the terminating end 62. The connecting beam 63 has the first and second angled portions 631, 632 and an intermediate portion 633 between the first and second angled portions 631, 632. The second angled portion 632 is angled along a second direction perpendicular to a mating direction to form itself as a Z-shape, and the first angled portion 631 is bent along a third direction orthogonal to the mating direction and the second direction to form itself as a U-shape. Along the mating direction, the connecting portion 61 and the terminating end 62 are aligned with each other and the intermediate portion 633 is not aligned with connecting portion 61, via the first and second angled portions 631, 632.

Figure 12:
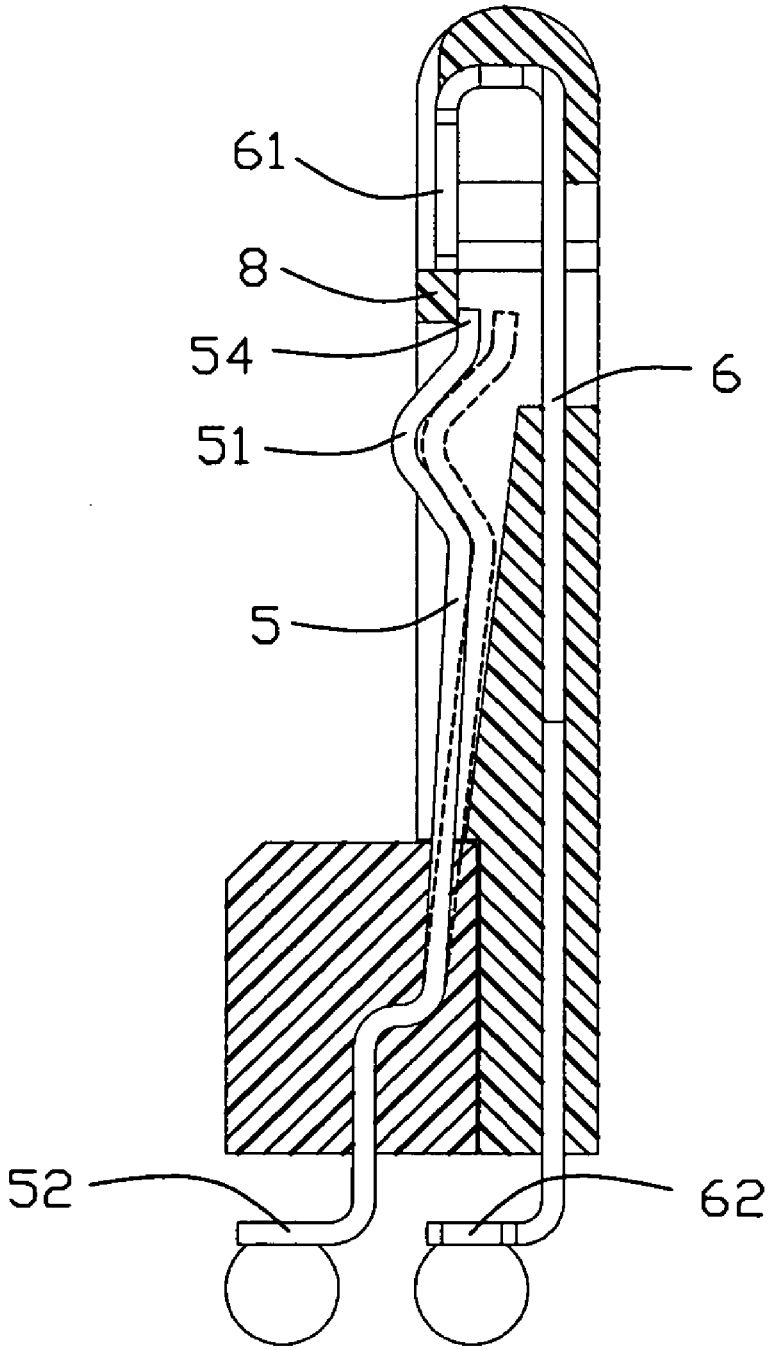
FIG. 12 is a schematic view showing a movement of the first terminal during a mating process.

Referring to FIGS. 7-11, the first and second terminals 5 and 6 are preferably retained to associated leadframe housings 211, 214 by insert molding. The second terminals 6 are mounted along their leadframe housing 211. The connecting beam 63 of the second terminal 6 is embedded in a leadframe housing 211 of the female plate 21, with the connecting portion 61 exposed to the outside. The first terminals 5 are embedded in the leadframe housing 214. The two leadframe housings 211, 214 may be suitably mounted together, for example, through pegs 215 and holes. The first terminals 5 are received in the terminal recesses 216. The connecting beam 63 of the second terminal 6 has a length longer than that of the contact beam 53 of the first terminal 5 to position the connecting portion 61 forwardly of the contact portion 51 within each female or male terminal pair 22, 42. The shelf 8 is disposed between the array of first terminals 5 and the array of second terminals 6. In conjunction with FIGS. 11 and 12, the tip end 54 of the first terminal 5 resists against the inner surface of the shelf 8. The first terminals 5 are pre-loaded via the shelf 8. The intermediate portion 533 of the first terminal 5 and the intermediate portion 633 of the second terminal 6 are staggered with each other within a same connector. The terminating end 52 of the first terminal 5 has a soldering portion leveled with a soldering feet of the terminating end 62 of the second terminal 6 in each female terminal module 2 (FIG. 12). Each terminating end 52, 62 of the first, second terminal 5, 6 has a soldering ball connected therewith. The assembly of the male terminal module 4 is same to that of the female terminal module 2.

Referring to FIGS. 1-4, in assembling of the female connector 10, the bending portion 252 of the first latching member 25 is inserted in the first slot 212 and the slit 2142 of the female plate 21 to tie all of the female plates 21 together, with the cutouts 253 engaging with the first slot 212 and the slit 2142. The female terminal modules 2 are inserted into the receiving cavity 11 of the female insulative housing 1, with a bottom of the leadframe housing 211 inserted in the channels 121 and other part of the leadframe housing 211 retained in the receiving cavity 11. The body portion 251 of the first latching member 25 is inserted in the second slot 122 of the female insulative housing 1. The female terminal modules 2 are fixed in the female insulative housing 1 via the first latching member 25.

In assembling of the male connector 30, the male plates 41 are tied together via the second latching member 45. The male terminal modules 4 are inserted into the retaining cavity 31 of the male insulative housing 3. The assembly of male connector 30 is same to that of the female connector 10.

When the male connector 30 is mated with the female connector 10 along the mating direction, the male insulative housing 3 is partially entering the receiving cavity 11 of the female connector 10, with the female terminal modules 2 inserted into the retaining cavity 31. The female terminal pairs 22 and corresponding male terminal pairs 42 come to mate with each other, with the curved mating face of the first terminal 5 sliding along and mating the flat mating face of corresponding mated second terminal 6. The contact portion 51 of the first contact 5 inclines inwardly, with the tip end 54 moving away from the shelf 8 (FIG. 12).

In conjunction with FIGS. 9 and 10, when the female terminal pair 22 is mated with corresponding male terminal pair 42, the first terminal 5 is substantially aligned with corresponding mated inverted second terminal 6, with the contact portion 51 of the first terminal 5 in contact with the inverted connecting portion 61 of the second terminal 6 at a first position A, and with the connecting portion 61 of the second terminal 6 in contact with the contact portion 51 of corresponding mated inverted first terminal 5 at a second position B. The first position A and the second position B are disposed at two different levels and are substantially aligned with each other along the mating direction. The contact portion 51 of the first terminal 5 of the female connector 10 and the contact portion 51 of the first terminal 5 of the male connector 20 are partially overlapped along the mating direction, and are spaced apart along a transverse direction perpendicular to the mating direction. As can be understood, the mating first and second terminals from the two mating modules can be suitably designated as either signal or ground contacts as desired.

The contact portion 51 of the first terminal 5 and the connecting portion 61 of corresponding mated second terminal 6 of the signal terminal pair 7 are presented to mate each other. Also, the mating face of the contact portion 51 of the first terminal 5 and the mating face of the connecting portion 61 of the second terminal 6 in a signal terminal pair 7 face toward a same direction. A transverse distance between the first position A and the second position B is smaller than a transverse distance between a lower end of the contact beam 53 and a lower end of the adjacent connecting beam 63. The contact and connecting portions 51, 61 of the first and second terminals 5, 6 of the signal terminal pair 7 extend toward a same direction. The soldering portions 52 and the soldering feet 62 extend toward a same direction in a same connector, and extend toward opposite directions in the female and male connectors 10, 30. The soldering portions 52 and soldering feet 62 has a plurality of soldering balls provided thereon for soldering. When the soldering portions 52 and soldering feet 62 are soldered with soldering balls, the first and second latching members 25, 45 could work as a heat sink.

The contact portion 51 of the female terminal pair 22 comes to contact with the connecting portion 61 of the male terminal pair 42 at the first position A. The connecting portion 61 of the female terminal pair 22 comes to contact with the contact portion 51 of the male terminal pair 42 at the second position B. Two electrical paths have been established; one electrical path may be used for grounding and the other may be used for transferring signal. The first position A and the second position B are disposed at two different levels and are substantially aligned with each other along the mating direction so that the space taken up in such contact interface arrangement will not extend beyond to occupy the space intended for adjacent modules. Therefore, the space occupied by the hermaphroditic terminals, i.e., first and second terminals, has been made of efficient use.

Referring to FIG. 15, the female insulative housing 1 of the female connector 10 could be designed into a greater height. The stack height of the connector assembly 100 is determined by the height of the female insulative housing 1.

The disclosure is illustrative only, changes may be made in detail, especially in matter of shape, size, and arrangement of parts within the principles of the invention.

What is claimed is:

1. A high density connector comprising:

a plurality of leadframes stacked one by one, each leadframe having a first leadframe housing and a second leadframe housing attached to the first leadframe housing;

an array of first terminals mounted along the second leadframe housing and an array of second terminals mounted along the first leadframe housing, the first terminal having a contact portion and the second terminal having a connecting portion; and a pair of latching members mounted at opposite sides of the leadframes to tie the plurality of stacked leadframes together, wherein said first leadframe housing has a pair of first slots defined at the opposite sides for engaging with the latching members, and wherein said second leadframe housing defines a pair of slits aligned with the first slots of the first leadframe housing and engageable with the latching members.

2. The high density connector as claimed in claim 1, wherein each latching member has a bending portion defining a plurality of cutouts engaging with the first slots of the first leadframe housings and the slits of the second leadframe housings.

3. The high density connector as claimed in claim 2, further comprising an insulative housing defining a pair of second slots, and wherein each latching member has a body portion connected to the bending portion and securely inserted in the second slot of the insulative housing.

4. The high density connector as claimed in claim 1, wherein said first leadframe housing has a plurality of terminal recesses and pegs, said second leadframe housing has a plurality of holes receiving the pegs, and the first terminals are accommodated in the terminal recesses.

5. The high density connector as claimed in claim 1, wherein said leadframe has a shelf between said two arrays of first and second terminals, the first terminal having a tip end resisting against an inner surface of the shelf

6. The high density connector as claimed in claim 5, wherein when the high density connector is mated with a mating connector; said contact portion of the first terminal is resisted against by the mating connector and the tip end of the first terminal leaves away from the shelf.

7. The high density connector as claimed in claim 5, wherein each leadframe has a plurality of pin holes for supporting the second terminals during insert molding, and the shelf is formed across the pin holes.

8. The high density connector as claimed in claim 1, wherein said contact portion of the first terminal comprises a curved mating face, and said connecting portion of the second terminal comprises a flat mating face.

9. The high density connector as claimed in claim 1, wherein each of said first and second terminals comprises an angled portion and an intermediate portion connected to the angled portion, the intermediate portions of the first and second terminals being staggered.

10. A high density connector assembly comprising:

a first connector and a mating second connector each comprising:

a plurality of leadframes stacked one by one, each leadframe having a first leadframe housing and a second leadframe housing attached to the first leadframe housing;

an array of first terminals and an array of second terminals respectively mounted along the second and the first leadframe housings, the first terminal having a contact portion and the second terminal having a connecting portion; and a pair of latching members mounted at opposite sides of the leadframes together with the first and second terminals to tie the plurality of stacked leadframes as a whole.

11. The high density connector assembly as claimed in claim 10, wherein said first terminal has a contact portion, the second terminal having a connecting portion, the contact portion of the first terminal and the connecting portion of the second terminal of two connectors are coextensive with each other.

12. The high density connector assembly as claimed in claim 11, wherein said leadframe has a shelf between said two arrays of first and second terminals, the first terminal having a tip end resisting against an inner surface of the shelf.

13. The high density connector assembly as claimed in claim 12, wherein said contact portion of the first terminal and the connecting portion of the second terminal of said two connectors come to contact with each other and the tip end of the first terminal leaves away from the shelf when said two connectors are mated with each other.

14. A connector assembly comprising:

a connector including a housing unit retaining a row of upper contacts and a row of lower contacts, said two rows being intimately side by side arranged with each other, an imaginary center line being defined between said row of upper contacts and said row of lower contacts, the upper contacts defining contact portions and lower contacts defining connecting portions at two different levels;

one of said contact portions and said connecting portions being a flexible type while the other being non-flexible type; and contact points of said contact portions being located by one side of said center line and those of said connecting portions being located by the other side of the center line, said row of upper contacts and row of lower contacts mating with mating contacts of a complementary connector along a same mating direction.

15. The connector assembly as claimed in claim 14, wherein only either the lower contacts or said upper contacts extend across the center line while the other not.

16. The connector assembly as claimed in claim 15, wherein the lower contacts extend across the center line, and both said contact portions of the upper contacts and the connection portions of the lower contacts face toward a same transverse direction, perpendicular to said mating direction, for engagement with the mating contacts of said complementary connector.

17. The connector assembly as claimed in claim 14, wherein the upper contacts and the lower contacts are both equipped with corresponding solder balls on corresponding solder portions respectively by two sides of the center line.

18. The connector assembly as claimed in claim 14, wherein the housing defines two discrete units respectively integrally retaining the upper contacts and the lower contacts.

19. The connector assembly as claimed in claim 14, wherein the contact point of the contact portion and the contact point of the connecting portion are located at two different levels.

* * * * *